United States Patent [19]

Weidler

[11] 4,107,499

[45] Aug. 15, 1978

[54] SWITCH ASSEMBLY FOR CIRCUIT BOARDS

[75] Inventor: Charles Harry Weidler, Lancaster, Pa.

[73] Assignee: AMP Incorporated, Harrisburg, Pa.

[21] Appl. No.: 753,405

[22] Filed: Dec. 22, 1976

[51] Int. Cl.[2] ..... H01H 15/04

[52] U.S. Cl. ..... 200/153 LA; 200/5 R; 200/16 R; 200/18; 200/292

[58] Field of Search ..... 200/16 R, 16 A, 16 C, 200/153 L, 153 LA, 159 B, 292, 339, 153 K, 5 R, 5 A, 16 D, 18

[56] References Cited

U.S. PATENT DOCUMENTS

| | | | |
|---|---|---|---|
| 2,909,624 | 10/1959 | Colautti | 200/153 K X |
| 3,047,682 | 7/1962 | Hults | 200/153 LA X |
| 3,221,115 | 11/1965 | Feher, Jr. | 200/16 R |
| 3,249,725 | 5/1966 | Hutt et al. | 200/153 LA |
| 3,737,601 | 6/1973 | Arthur et al. | 200/16 D X |
| 3,749,872 | 7/1973 | Foster | 200/292 |
| 3,854,018 | 12/1974 | Reynolds et al. | 200/16 R X |
| 3,858,012 | 12/1974 | Lockard | 200/339 X |
| 3,917,921 | 11/1975 | Jakubauskas | 200/16 R X |
| 4,057,520 | 11/1977 | Schwartz | 200/16 D |

*Primary Examiner*—Stephen Marcus
*Attorney, Agent, or Firm*—Frederick W. Raring

[57] ABSTRACT

A switch assembly for a printed circuit board comprises fixed and movable contacts mounted on the circuit board and a separate switch housing mounted on the board which encloses the contacts. The housing has a slidable actuator cam therein which closes and opens the contacts, depending upon its position, and holds them in one condition or the other. The cam is actuated by an externally extending lever. An improved assembly method is also disclosed for assembling switches to circuit boards.

6 Claims, 10 Drawing Figures

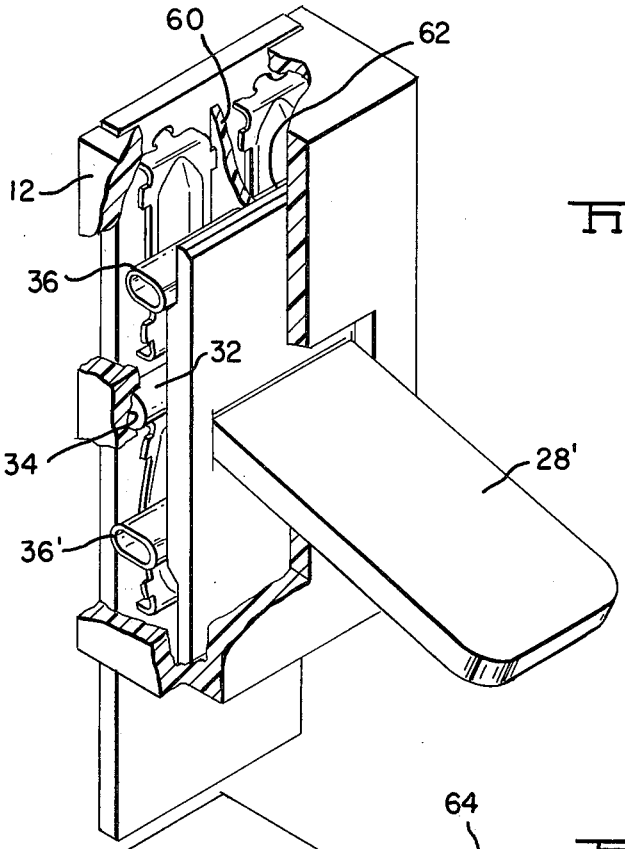
Fig. 8
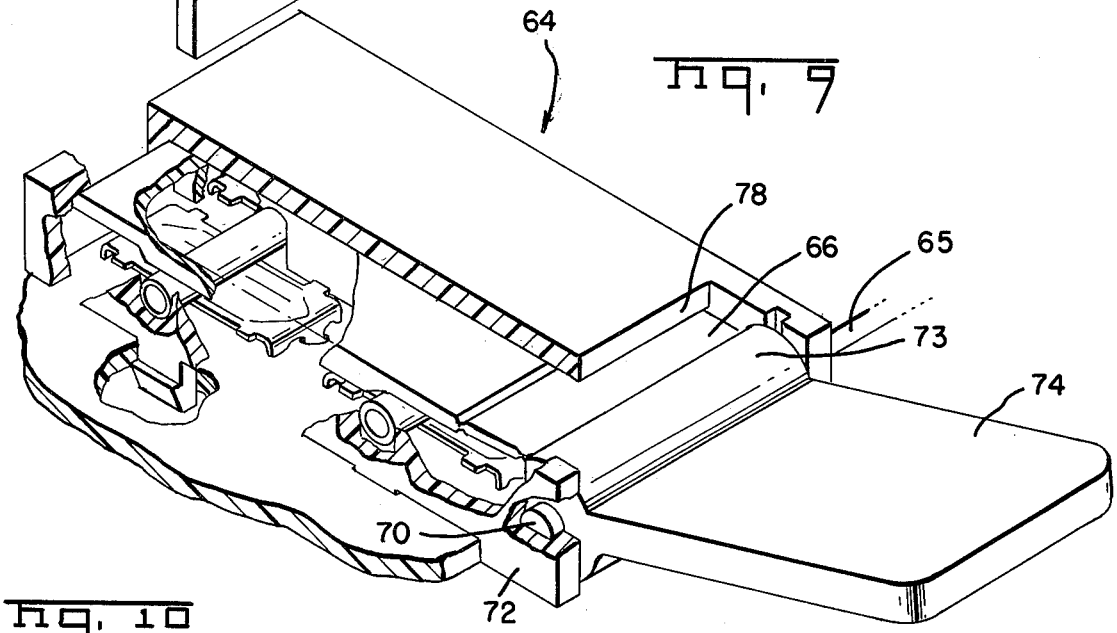
Fig. 9
Fig. 10
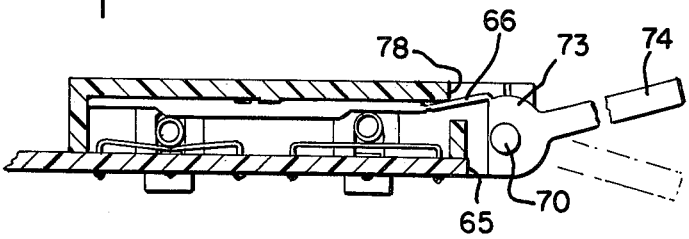

SWITCH ASSEMBLY FOR CIRCUIT BOARDS

BACKGROUND OF THE INVENTION

This invention relates to electrical switches for printed circuit boards for completing and interrupting circuits between conductors on the circuit board.

Ordinarily, the switching means for conductors on printed circuit boards is mounted externally of the board and the conductors on the board are connected to the switch means by printed circuit board connectors and conductors which extend from the printed circuit board connectors to the switch means.

There is, however, a growing tendency to provide switches directly on the circuit boards. Key board switches are, of course, widely used in electronic calculators but switches of this type are intended only to be closed momentarily under the influence of finger pressure and they can not be used where it is desired to maintain a circuit path between two conductors on the circuit board for an extended period. There are also available selfcontained switches for printed circuit board use which have the appearance and the dimensions of a DIP (dual inline package). Switches of this type have leads extending therefrom which are soldered to the conductors on the printed circuit board and the leads extend to the contacts which are contained in the switch housing. Switching is carried out by switch toggle mechanisms or the like which are actuated from the upper surface of the housing. Switches of this type, having the dimensions and appearance of a DIP are being widely used but they are not suitable under many conditions; for example, where the circuit board and the conductors on the circuit board are relatively coarse in size and where the conductors which are to be connected through the switch are not as close together on the circuit board as are required by a DIP type switch. Circuit boards are being used to an increasing extent on the control systems for appliances, in automotive electrical circuits, in musical organs, and in similar applications and there is a definite need for an inxpensive reliable switch for such applications.

It is accordingly an object of the invention to provide an improved switch means for a cicuit board. A further object is to provide a low cost switch means for a circuit board which can be used for a wide variety of switching functions and which can be adapted to a variety of specific configurations. A further object is to provide a switch assembly for a circuit board which contains, as the metallic switch contacts, the same type of contacts as are used in conventional key board switches. A further object is to provide an improved method of assembling switches to printed circuit boards.

These and other objects of the invention are achieved in preferred embodiments thereof which are briefly described in the foregoing abstract, which are described in detail below, and which are shown in the accompanying drawng in which.

Figure 4:
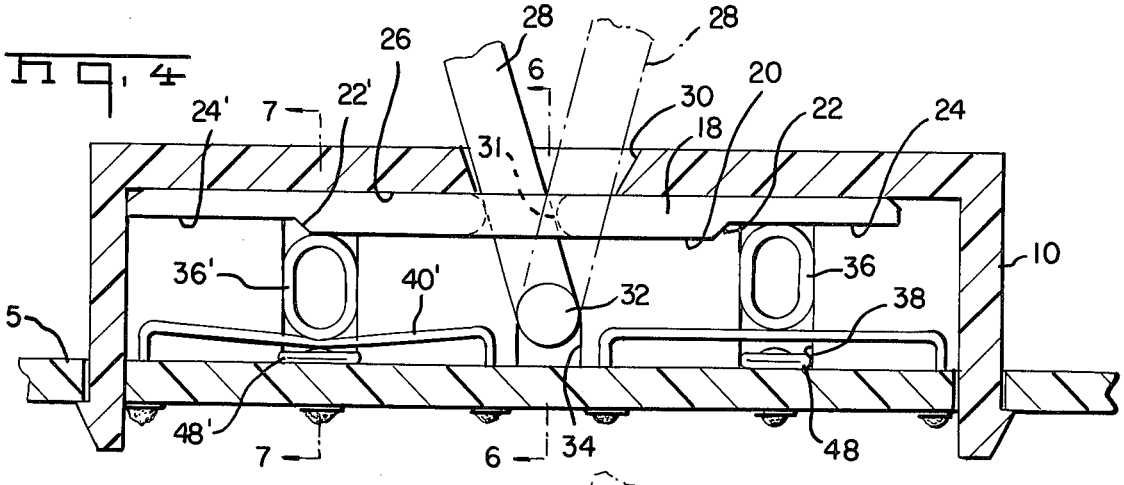
FIG. 4 is a transverse sectional view of the switch assembly of FIG. 1.
Figure 6:
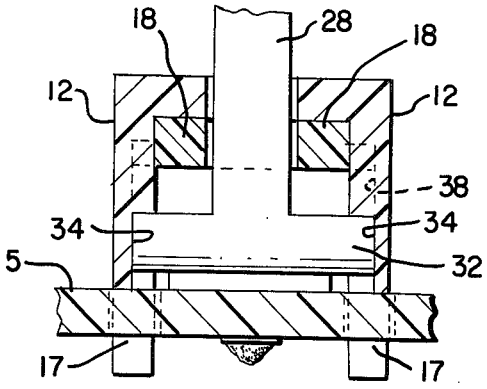
Figure 7:
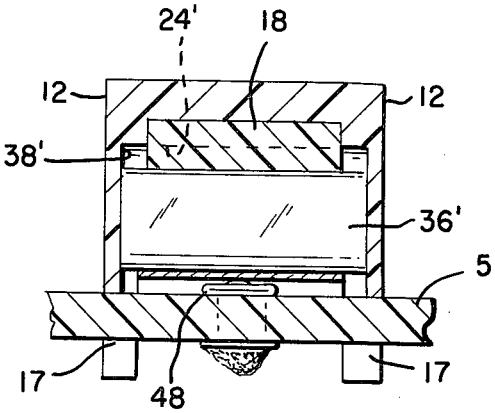

FIGS. 6 and 7 are views taken along the lines 6—6 and 7—7 respectively of FIG. 4.

Figure 1:
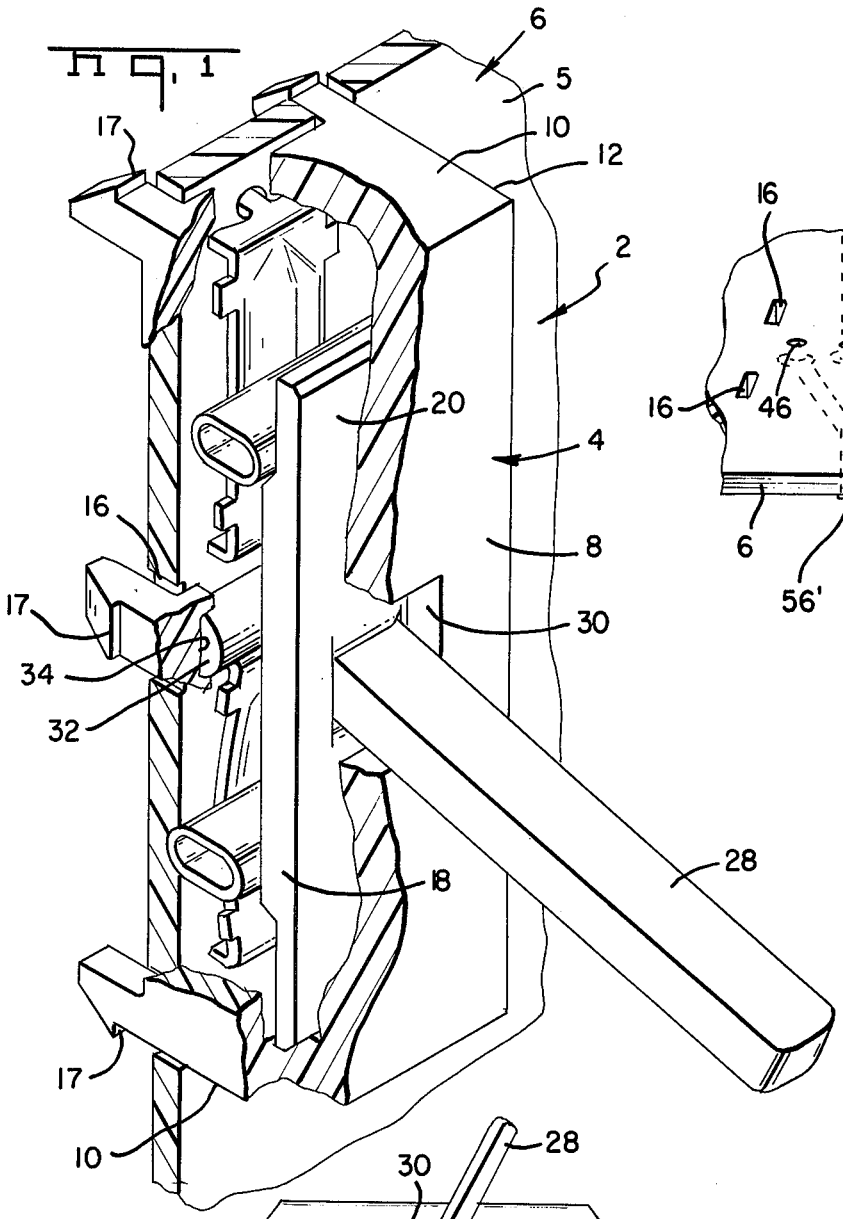
FIG. 1 is a fragmentary perspective view, with parts broken away, of one form of switch assembly in accordance with the invention.
Figure 2:
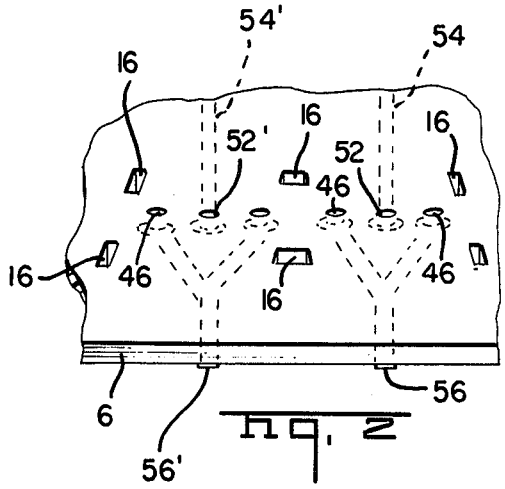
FIG. 2 is a fragmentary perspective view of a portion of a printed circuit board having thereon conductors which are to be provided with switch means in accordance with the invention.

FIG. 8 is a view similar to FIG. 1 but showing a switch assembly in accordance with the invention of the double pole double throw type.

FIG. 9 is a perspective view of an alternative embodiment which is mounted adjacent to an edge of the circuit board.

FIGS. 1–4 show an embodiment of the invention which is effective to complete a circuit between either of two pairs of conductors 54, 56 or 54′, 56′ on a printed circuit board 6. The switch assembly comprises a generally prismatic housing 4 mounted on one surface 5 of the board and having a top wall 8, depending sidewalls 12, and end walls 10. It will be noted that the housing does not have a bottom wall or base and that it encloses a portion of the circuit board on which the switch contacts are mounted. The housing 4 is secured to the board by latch arms 14 which extend from the end walls 10 and the sidewalls 12 and which project through suitably located openings 16 in the circuit board. The latch arms have enlarged free ends as shown and are slightly flexible relative to the walls of the housing so that the housing can be assembled to the circuit board by merely pushing the latch arms through the openings until the shoulders 17 of the arms engage the surface 7 of the board.

The condition of the switch is changed by means of an actuator means comprising a generally flat camming plate 18 disposed against the internal surface 26 of the top wall 8 and which is slidable rightwardly from the position of FIG. 4 towards the right hand end wall 10. Caming plate 18 has a planar central section 20, inclined rise portions 22, 22′ at each end of the central section, and end planar sections 24, 24′. Camming plate 18 is switched or moved rightwardly or leftwardly within the housing by means of a lever 28 which extends through an enlarged opening 30 in top wall 8, through a somewhat smaller opening 31 in the camming plate, and which has integral gudgeon pins 32 on its lower end. These gudgeon pins are received in recesses 34 in the sidewalls 12, FIG. 6, so that when the lever 28 is shifted to the dotted line position of FIG. 4 the camming plate 18 will be moved rightwardly from the position of FIG. 4.

A pair of tubular depressors 36, 36′ are contained in the housing and have their ends received in recesses 38 in the opposed surfaces of the sidewalls 12 as shown best in FIG. 4. These depressors are advantageously of a relatively firm and sufficiently strong plastic material and they are interposed between the downwardly facing surface of the cam plate and the movable spring contacts 42, 42′.

Figure 3:
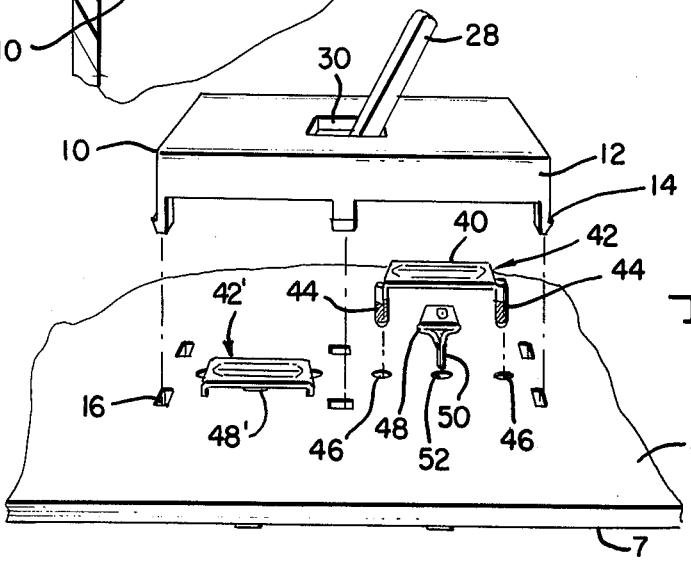
FIG. 3 is a view similar to FIG. 2 but showing components of the switch assembly exploded from the surface of the circuit board.

The movable contacts 42 comprise generally rectangular sheet metal spring members with upwardly formed central portions having depending integral mounting post portions 44 thereon. The mounting post portions are inserted through openings 46 which extend through the circuit board 6 and through branches of the conductor 56 on the surface 7 of the circuit board as shown in FIG. 4. The lower ends of these mounting portions 44 are soldered to the branches of the conductors 56 in the conventional manner. The fixed contact 48 comprises a generally flat crown portion having an upwardly extending boss and a depending mounting portion 50 which is inserted through an opening 52 in the circuit board. The mounting portion 50 of the fixed contact is soldered to the conductors 54 on the underside of the board. The fixed and movable contacts 42', 48' which appear on the left in FIG. 3 are, of course, identical to the conductor 42, 48. It should also be mentioned that the spring contacts 42, and fixed contacts 48 are of a type commonly used for key board switches as described in application Ser. No. 737,811, filed Nov. 1, 1976. Alternative types of fixed and movable contacts can be used in the practice of the invention rather than the specific contacts shown.

The operation of the switch shown in FIG. 1 will be apparent from an inspection of FIG. 4. When the lever 28 is in the solid line position of FIG. 4, the central section 20 of the camming plate is against the upper end of the depressor 36' and this depressor functions to maintain the movable spring contact 40' in engagement with the fixed contact 48' so that a circuit is completed between the conductors 54' and the conductors 56'. The depressor 36, however, is against the surface 24 on the right hand end of the camming plate which is elevated above the level of the surface 20 so that the movable contact 40 is not in engagement with the fixed contact 48 and the conductor 54 is not connected to the conductor 56. When the lever 28 is swung to the dotted line position of FIG. 4, the positions of the depressor 36, 36' are reversed and the circuit between conductors 54', 56' is broken while a circuit path is completed between the conductors 54, 56.

It will be apparent from the foregoing that the movable springs 40, 40' function as return springs in that it is the resilient force of these springs which return the depressors 36, 36' to their raised positions when the cam plate is slid from one position to the other. A properly designed movable contact key board switch will ordinarily have a spring contact which is sufficiently strong and resilient to carry out this function since key board switches are ordinarily closed when the operator presses on the movable contact and such switches must therefore be designed to withstand a certain amount of abuse.

FIG. 3 illustrates the steps in the assembly process of producing a completed switch assembly as shown in FIG. 1. The fixed and movable contacts 42, 48 are assembled to the circuit board by insertion of the mounting portions 44, 50 of the contacts through the holes in the circuit board. These contact insertion operations are advantageously carried out by means of automatic or semi-automatic insertion machinery while the circuit board is being assembled. The contacts themselves are extremely inexpensive and the assembly operation can also, therefore, be carried out at a very low cost. The contacts are soldered to the conductors by a conventional wave soldering process and this step again can be carried out at very low cost during an assembly line manufacturing process. As a final step, the switch housing 4 is assembled to the circuit board by merely aligning the mounting arms 14 with the openings 16 as shown in FIG. 3 and moving the housing downwardly until the mounting arms extend through the openings. In effect then, the assembly process in which the switch is manufactured is carried out concurrently with the manufacture of the printed circuit board and separate switch assembly operations are largely avoided. This feature contributes significantly to the low cost of the switch components and to the extremely low applied cost, that is, the total cost of the switch to the user after it has been assembled to the circuit board.

FIG. 4 shows a switch assembly which is effective during shifting of the lever 28 to the dotted line position to interrupt or break the circuit between the conductors 54' and 56' prior to completing the circuit between the conductors 54, 56. The extent of the surface 24 permits slight rightward movement of the cam 18 from the position of FIG. 4 prior to downward movement of the depressor 36 and during this initial movement of the cam, the circuit between conductors 54' and 56' is broken. If a "break before make" switching arrangement is desired, the alternative form of cam plate 59 of FIG. 5 can be used. The cam plate in this Figure has the rise surface which is immediately adjacent to the depressor 36 when the lever is in the solid line position so that upon initial rightward movement of the cam plate, depressor 36 moves dowwardly and completes the circuit from the conductor 54 to conductor 56 but the circuit between conductors 54' and 56' maintained during this brief interval by virtue of the fact that the rise surface 61' is displaced leftwardly as compared with the surface 22' of the cam plate 18. It will be apparent that many other switching arrangements can be achieved by merely changing the contour of the downwardly facing surface of the cam plate. For example, both of the depressors 36, 36' can be mantained in their lowered positions to complete the circuits when the lever is in one position and both can be permitted to rise or move upwardly when the lever is in its other position.

It will be appreciated that a relatively simple switch can be provided in accordance with the invention which would be effective to merely open or close a circuit between two conductors on the circuit board. An embodiment of this type would have a somewhat smaller housing 4 and would have a cam plate which would be designed to engage only a single depressor member 37 for closing a single pair of fixed and movable switch contacts.

The principles of the invention can also be employed to obtain more complex switching operations. For example, FIG. 8 shows a housing having a central wall 60 which extends parallel to the sidewalls 12 and the cam plate extends for the full width of the housing. A double throw switching arrangement is provided in each of the chambers which are between the central wall 60 and the sidewalls 12. Shifting of the switch lever thus effects a total of four circuits and any desired combination of closing or opening operations can be obtained if separate depressors and properly contoured camming surfaces are provided. That is, a separate depressor can be provided at the upper end and at the lower end of the housing in each of the two chambers and the camming plate can be designed to end open or close any one of the contact pairs which are engaged between plates. It will be apparent also that any reasonable number of side-by-side pairs of contacts can be provided in a single switch housing and contoured by a single lever.

FIG. 9 shows an alternative embodiment 64 in which the housing is mounted adjacent to an edge 65 of the circuit board and the lever or handle 74 extend beyond the edge of the circuit board. The lever had an enlarged inner end 73 having integral gudgeon pins 70 which are received in recesses in an end portion 72 of the housing. The enlarged end 73 of the lever is connected by a link section 66 to the cam plate which is otherwise similar to the cam plate described above. The cam plate, the connecting link section 66, and the lever 74 can be molded as one piece or section and the housing differs from the previously described housing only in that it has an opening 78 through which the connecting section 66 extends. It will be apparent that many other types of actuating linkage systems can be used in accordance with the principles of the invention.

Figure 5:
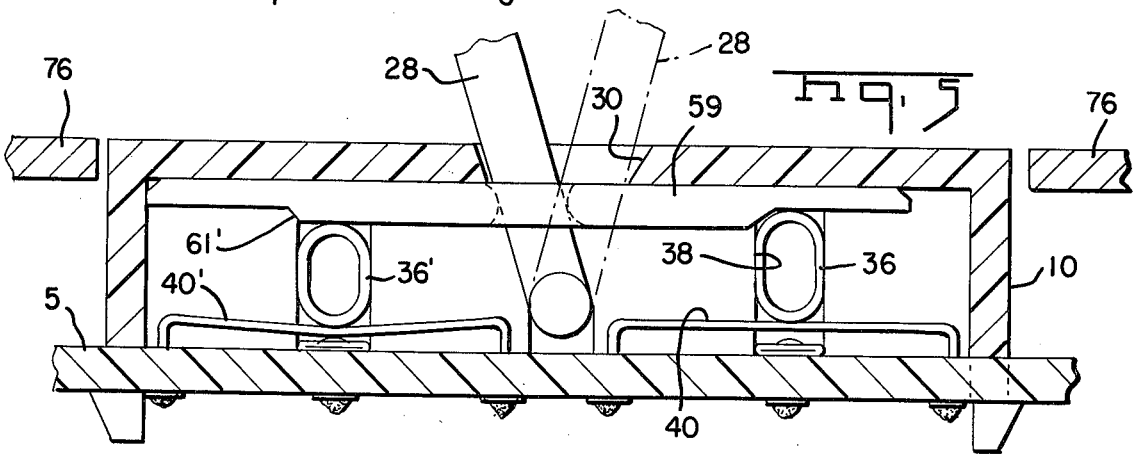
FIG. 5 is a view similar to FIG. 4 showing a switch having an alternative form of switching cam means therein.

As mentioned above, switch assemblies in accordance with the invention can be used on the circuit boards of appliances, musical organs, automotive wiring systems, and other similar applications or circumferences. Quite often, the circuit board will be spaced from an exterior panel 76 of the apparatus in which the circuit board is used as shown in FIG. 5. The panel is designed with an opening which conforms to the external dimensions of the housing so that the circuit board can be removed from the apparatus without the requirement that a separate switch on the surface of the panel be removed.

What is claimed is:

1. A switch assembly on a circuit board for closing and opening a circuit between two conductors on said board, said switch assembly comprising:

a pair of fixed and movable keyboard switch contacts on said circuit board, said fixed contact comprising a fixed button type contact on said board which is electrically connected to one of said conductors, said movable contact comprising a generally rectangular spring member having mounting legs extending from each end thereof, and having side edges between said ends, said mounting legs extending into said circuit board and being electrically connected to the other one of said conductors on said circuit board, said spring member being upwardly concave and being resiliently deformable downwardly and into contact with said fixed contact, a switch housing which is separate from said contacts, said housing being in enclosing relationship to said contacts and having a top wall and opposed sidewalls which are spaced from said side edges of said movable contact, said housing having integral latch arms extending through openings in said circuit board to latch said housing to said circuit board, actuator camming means slidably contained in said housing against said top wall, said actuator camming means being movable parallel to said circuit board between first and second positions, motion translating means extending between said sidewalls and transversely with respect to said side edges of said movable contact, groove means in said sidewalls, end portions of said motion translating means extending into said groove means for guiding said motion translating means towards and away from said movable contact, said actuator camming means being effective upon movement from said first position to said second position to engage said motion translating means and move said motion translating means towards said movable contact whereby said translating means flexes said movable spring contact towards said fixed contact thereby to close said switch, said movable spring contact being effective to move away from said fixed contact upon movement of said actuator means from said second position to first position and to move said motion translating means towards said top wall.

2. An assembly as set forth in claim 1, said motion translating means comprising a hollow plastic tube.

3. An assembly as set forth in claim 1, said actuator camming means comprising a cam plate and a lever concatenated thereto and extending externally from said switch housing.

4. An assembly as set forth in claim 3, said assembly being mounted centrally in said circuit board, said lever extending externally through an opening located centrally in said top wall of said housing.

5. An assembly as set forth in claim 3, said lever extending externally through an opening located in an end wall of said housing which is adjacent to said edge.

6. An assembly as set forth in claim 1, said circuit board having an additional fixed contact thereon and an additional movable contact, said additional contacts being disposed adjacent to said contacts; said assembly having an additional motion translating means, said additional motion translating means being disposed adjacent to said motion translating means, and said actuator camming means being effective upon movement from said second position to said first position to engage said additional motion translating means to move said additional motion translating means towards said additional movable contact whereby said additional motion translating means flexes said additional movable spring contact towards said additonal fixed contact thereby to close a second circuit, said additional movable spring contact being effective to move away from said additional fixed switch contact upon movement of said actuator means from said first position to said second position and to move said additional motion translating means towards said top wall.

* * * * *